United States Patent [19]

Jordan

[11] Patent Number: 4,949,615

[45] Date of Patent: Aug. 21, 1990

[54] INDEXABLE INSERT CUTTERS

[75] Inventor: James W. Jordan, Coventry, England

[73] Assignee: Sandvik Hard Materials, Ltd., Coventry, England

[21] Appl. No.: 190,089

[22] Filed: May 4, 1988

[30] Foreign Application Priority Data

May 21, 1987 [GB] United Kingdom ..... 8712080
Jul. 24, 1987 [GB] United Kingdom ..... 8717591

[51] Int. Cl.[5] ..... B26D 1/62

[52] U.S. Cl. ..... 83/674; 83/343; 83/698; 83/955

[58] Field of Search ..... 83/674, 673, 343, 346, 83/698, 955; 269/84, 85, 82, 83

[56] References Cited

U.S. PATENT DOCUMENTS

| | | | |
|---|---|---|---|
| 3,209,633 | 10/1965 | Doerman | 83/346 |
| 3,340,757 | 9/1967 | Rudszinat | 83/348 |
| 4,366,737 | 1/1983 | Bedford | 83/677 |
| 4,370,908 | 2/1983 | DeAlto et al. | 83/677 |
| 4,382,458 | 5/1983 | Schadlich et al. | 144/230 |
| 4,485,710 | 12/1984 | Schlisio et al. | 83/343 |
| 4,503,867 | 3/1985 | Barbe et al. | 83/677 |

FOREIGN PATENT DOCUMENTS

| | | | |
|---|---|---|---|
| 0016615 | 10/1980 | European Pat. Off. . | |
| 266021 | 10/1913 | Fed. Rep. of Germany | 83/343 |
| 1436506 | 11/1968 | Fed. Rep. of Germany . | |
| 3311796 | 10/1984 | Fed. Rep. of Germany . | |
| 2086600 | 12/1971 | France . | |
| 934295 | 8/1963 | United Kingdom . | |
| 1469684 | 4/1977 | United Kingdom . | |
| 2046651 | 11/1980 | United Kingdom . | |

*Primary Examiner*—Hien H. Phan
*Attorney, Agent, or Firm*—Burns, Doane, Swecker & Mathis

[57] ABSTRACT

A drum cutter for paper cutting operations has a series of bar-like cutter inserts at angularly spaced positions around its periphery. The inserts are indexable and are held by clamping elements that engage them at points spaced from their ends to draw them radially inwards against bearing faces on the cutter drum or on support members which are themselves detachably mounted on the drum. The clamping elements are tightened by screws extending axially into each end of the drum. The inserts are clamped against bearing surfaces which are at a smaller radius in a region between the clamping elements than they are in end regions beyond the clamping means, so as to give the operative cutting edge a concave profile.

14 Claims, 3 Drawing Sheets

INDEXABLE INSERT CUTTERS

FIELD OF THE INVENTION

This invention relates to cutters having a rotatable body on the periphery of which at least one elongate cutting element is mounted to extend substantially axially of the body.

SUMMARY OF THE PRIOR ART

Such cutters, typically with a drum-form body with a number of cutting elements mounted at spaced positions about its periphery, are used in paper cutting operations such as cutting webs of sheet material for the wrapping of cigarette tips and like generally cylindrical somkers' products, in particular in filter tipping machines.

In a known form of drum cutter for filter tipping machines, the cutter elements are fixed in bar-like carriers which are located in recesses extending the length of the drum and which are retained by end rings which are bolted onto the drum to hold the carriers against centrifugal forces that urge them radially outwards on the drum. In another known form of drum cutter, indexable inserts are used, the inserts being mounted directly in the recesses in the periphery of the drum, the insects being held by end rings at opposite ends of the drum clamping on the ends of the inserts. By releasing them from the end rings, the inserts can therefore be indexed to present new cutting edges. In another known drum cutter having indexable inserts mounted directly in the drum, the inserts are held by washers pressed onto one face of the insert by screws threaded into the drum. Although such arrangements have obvious cost advantages, they have not proved successful, however, because it is difficult to ensure uniform clamping and indexing of each insert.

SUMMARY OF THE INVENTION

According to the present invention, there is provided a cutter comprising a rotatable body having at least one elongate cutter insert mounted on its periphery and extending axially of the body, and clamping means displaceable towards the rotary axis of the body to clamp the insert releasably upon the body.

Preferably, the cutter has a polygonal cross-section and the clamping means acts on a pair of the cutter faces on opposite sides of a radial plane extending through an operative cutting edge, the two faces being oppositely inclined to that plane being directed away from the rotary axis; in this manner the insert can be rigidly retained by a resultant clamping force the line of action of which passes through or close to the operative cutting edge.

For cutting operations for filter tipping machines, it is desirable to have a cutting edge that is slightly concave in the radial plane. In a cutter according to the invention, by having the ends of the insert projecting beyond the clamping means and held by said clamping means against bearing faces that are at a greater radial distance from the axis of rotation of the cutter than a further bearing face or faces within the span of the clamping means, it is possible to ensure that the operative cutting edge is deformed to a concave profile.

Preferably, the insert is held by said clamping means on an elongate support adjustably mounted on the periphery of the body and extending substantially axially thereof. In such an arrangement, the support can take the form of a bar-like member generally coextensive with the cutting insert to support the insert along its length. By releasing the clamping means, the inserts can be freed from the support and turned to present a new operative cutting edge before being secured in place again. The support can itself pivot against abutment means to allow tilting of the cutting insert in the manner already known in the art.

Embodiments of the invention are illustrated by way of the example in the accompanying schematic drawings.

DESCRIPTION OF THE PREFERRED EMBODIMENTS

Figure 1:
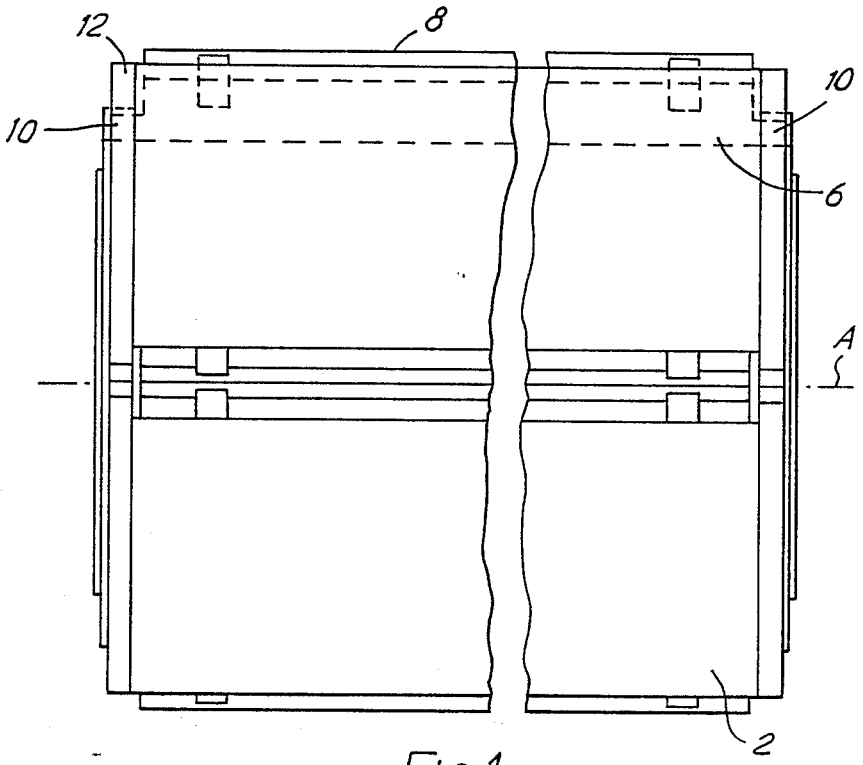
FIG. 1 is a front view of a cutter drum according to the invention.
Figure 2:
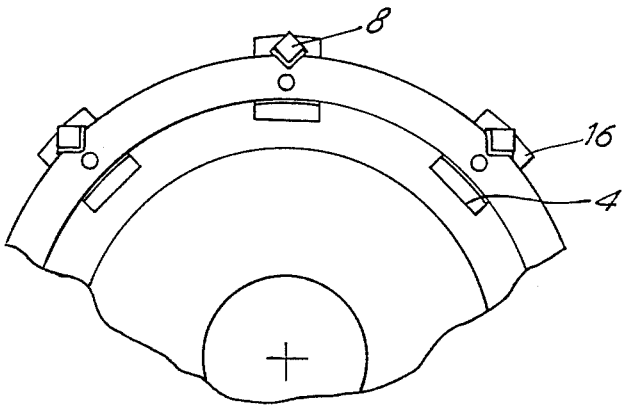
FIG. 2 is a partial end view of the drum in FIG. 1.

FIG. 1 illustrates a cutter drum for a filter tip machine, the function of which is to sever a travelling web of outer wrapping material to provide lengths of material that are used as wrappings for the filter tips of cigarettes. The drum is arranged to rotate about a central axis A and comprises a generally cylindrical body 2 having axial recesses 4 regularly spaced around its circumference providing mountings for bar-like supports 6 on which are held square section cutting inserts 8 manufactured from a hard metal such as tungsten carbide. The supports provide a rigid backing for the inserts along their full length. The inserts extend to the ends of the cutter body 2 but their supports have stepped end extensions 10 that project beyond ends of the body. The supports are retained in the recesses of the drum by end rings 12 bolted to the drum and overlapping the end extensions 10.

Figure 3:
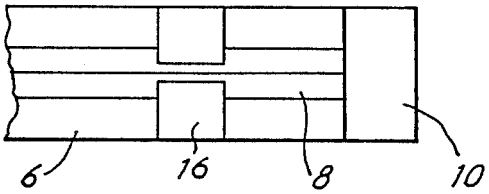
FIG. 3 is a plan view of one end of a cutting insert in its support.
Figure 4:
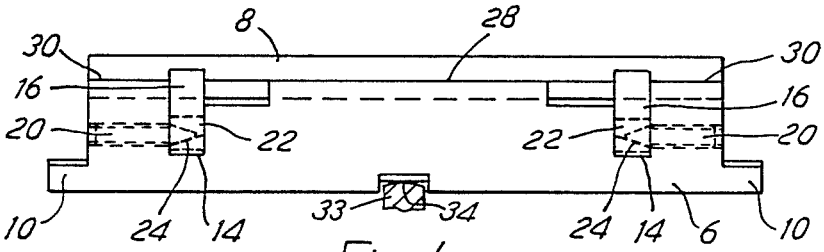
FIGS. 4 and 5 are an axial view and a partly sectioned end view of the parts shown in FIG. 3, illustrating the means of securing the insert.
Figure 5:
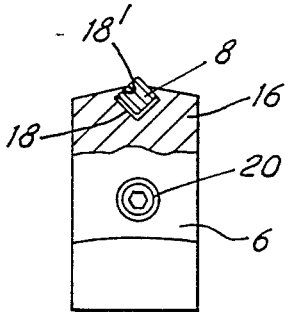

To clamp the inserts on their supports, FIGS. 3 to 5 show an arrangement in which, adjacent the ends of the supports, there are slots 14 that open radially outwards and that have respective clamping elements 16 located in them. Each element has a recess 18 in its outer edge in which the insert is freely slidable, with a cutting edge of the insert lying proud of the clamping element radially outer edge. The recess includes a pair of outer faces 18' that engage the obligue outwardly directed faces of the insert on each side of the cutting edge so that the insert is held against displacement radially outwards. Preferably, a corresponding angle V-slot is provided along the length of the support, to receive the insert, with the faces of the slot at the same angle as the inwardly directed faces of the insert, the resultant clamping force on the faces 18' acting substantially through the cutting edge and pulling the insert directly into the V-slot. Each clamping element is retained in the support by means of a grub screw 20 extending axially from the adjacent end face of the support into a aperture 22 in the element. The screw has a conical nose which engages a tapered face 24 in the element aperture to exert a camming action as the screw is driven in, which draws the insert firmly against the support.

The V-slot in the support in which the insert seats is cut away adjacent the clamping element locations to leave as a backing for the insert a main central bearing face 28 and two shorter outer bearing faces 30, with the central bearing face spaced away from its adjacent clamping element. The outer faces project further radially than the central face, eg. being higher by about 0.0003–0.0005 inches (0.0075–0.012 mm), although each of the three bearing faces extends parallel to the drum rotary axis. With higher and lower bearing faces so disposed on opposite sides of the clamping points of the insert, as the clamping elements pull the insert down against the bearing faces, its operative cutting edge is deformed to a concave profile.

The provision of such a profile for a paper-cutting blade is known to have advantages. In particular by severing a paper web at its opposite edge regions first, any tendency of the web to tear can be reduced or eliminated. If an indexable insert of hard material is to be used to provide the cutting edge, the extremely brittle nature of the insert material would suggest that the cutting edges would have to be preformed to a concave profile in order to be used in this way. It is found, however, that the illustrated configuration can achieve the required concave profile from a uniform cross-section insert, the flexure of the insert as it is clamped onto its support giving the chosen operative cutting edge the required profile in each case.

Circumferential displacement of the insert is prevented because both the support and its clamping elements are located in their cutter drum recess 4 when the end rings 12 are secured. The cutting insert is thus held rigidly on the support to be adjustably displaceable in a known manner with the support, while being readily releasable when the operative cutting edge is to be changed. For this purpose, it is simply necessary to loosen the grub screws 20 at the opposite ends of the support to release the force clamping the insert against the support. The insert can then be slid out and returned to its seating with a fresh cutting edge in the operative position. It can be arranged that the drum end rings 12 have recesses both to allow access to the grub screws 20 and to allow the inserts to be slid in and out of their supports for indexing purposes. In this way, the insert edges can be changed without requiring any other parts to be disassembled.

In use, the supports are urged outwardly against limit stops provided by the end rings. The cutter drum cooperates with a further drum to cut the paper web or the like and when each cutting insert is performing a severing operation, through its co-action with the opposed further drum its support adjusts automatically to the required position. As is known in the art, there is provided an adjustable pivot 33 in the drum structure midway along each axial recess to engage a seating 34 on the support 6 so that the support can be tilted to adjust its alignment, but a description of these known means of adjustment of the support is not required for an understanding of the invention.

Figure 6:
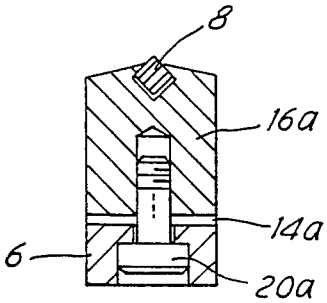
FIG. 6 is a transverse section illustrating an alternative securing means.

FIG. 6 illustrates an alternative clamping arrangement which has radially directed clamping elements **16*a* with heads seating in recesses 14*a* in the support 6 to secure an insert to the support in an analogous way to the embodiment described above, using a clamping screw 20*a*. In this case, the clamping screw runs radially from the inner face of the support into its clamping element 16*a***.

Figure 8:
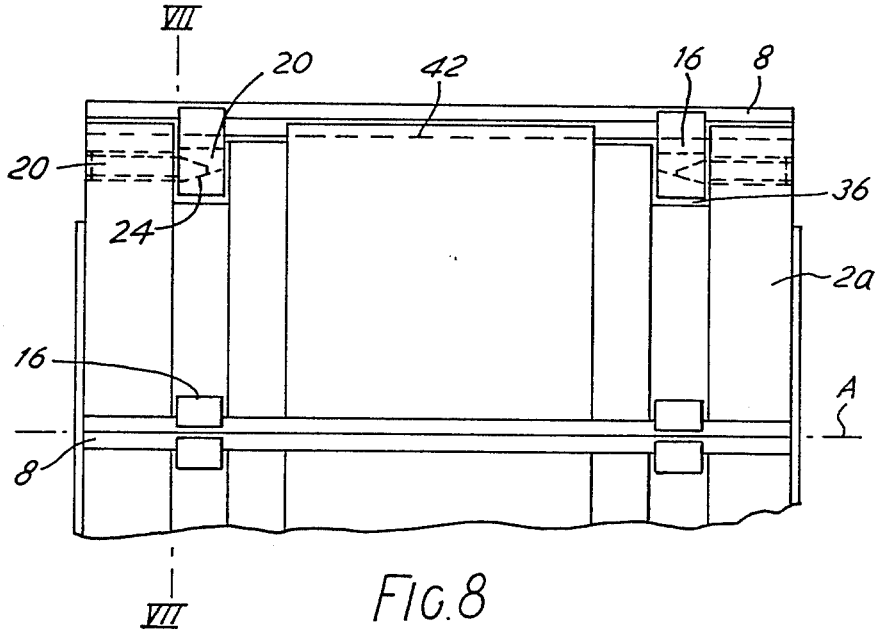
FIGS. 7 and 8 are partial views of a further rotary cutter according to the invention, in radial section on VII—VII in FIG. 8 and in side view respectively.
Figure 7:
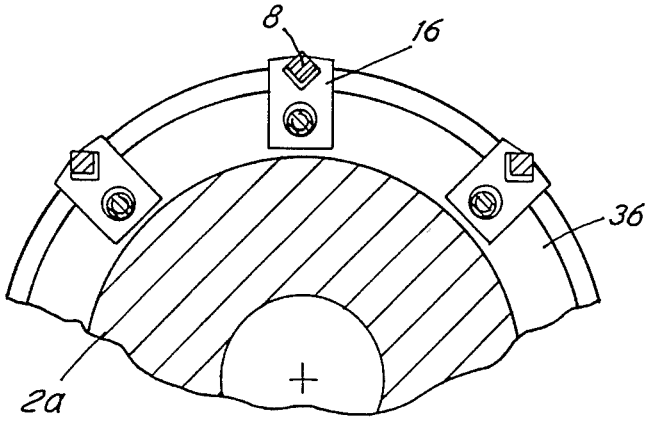

Referring now to FIGS. 7 and 8, these show a cutter according to the invention in which the indexable inserts 8 are secured directly to rotary drum **2*a*. The drum construction is symmetrical about a central radial plane and stepped circumferential grooves 36 are spaced on each side of that plane. Each stepped groove consists of a deeper annulus nearer the adjacent end of the drum and a shallower annulus inwards of this. At equiangular intervals around its periphery, axial V-grooves 42 run the length of the drum. The axial grooves are interrupted by the circumferential grooves and their depth changes at these interruptions, the portions between the circumferential grooves being at a slightly smaller radius than the end portions of the axial groove, analogously to the V-slot in the support 6** of the first example.

The V-slots receive the indexable inserts 8 in this case also. The deeper annuli of the circumferential grooves house the clamping elements 16 which can be identical to the elements in the first example and can be tightened down by the same clamping screws 20, in this case the screws being threaded into axial boresx in the end walls of the drum **2*a*. As will be clear from the preceding description, the clamping elements here act similarly, applying a radially inward force, to hold the cutting inserts firmly in the axial slots of the drum in operation, to ensure maximum rigidity. They can be loosened by turning these screws 20** when a fresh cutting edge of an insert is to be used or the insert replaced.

I claim:

1. A cutter comprising a body having an axis of rotation, a periphery of said body extending in the direction of said axis, at least one elongate cutter insert having at least one cutting edge at said periphery of the body and extending axially of the body, and clamping means displaceably mounted on the body, said clamping means comprising, for said at least one cutter insert, a plurality of axially spaced clamping elements, each said clamping element comprising a pair of spaced clamping faces directed obliquely inwards of the cutter body at opposite inclinations to said periphery, said insert having a polygonal cross-section comprising outwardly inclined faces on opposite sides of an operative cutting edge of the insert for a engagement by said spaced clamping faces, said clamping elements having freedom of movement towards and away from the rotary axis of the body for applying a generally radially inward force clamping said cutter insert releasably upon the body.

2. A cutter according to claim 1 wherein a plurality of peripheral recesses are formed on the cutter body, and are axially spaced correspondingly to said clamping elements for receiving said elements in said peripheral recesses.

3. A cutter according to claim 1 further comprising an elongate support for the cutter insert, said support being adjustably mounted on the periphery of the body and extending substantially axially thereof, said insert being held on the support by said clamping means.

4. A cutter according to claim 1 wherein ttightening means are carried by the body and are displaceable axially of the body from at least one end thereof for engagement of the clamping means whereby to apply clamping pressure to the insert.

5. A cutter comprising a body having an axis of rotation, a periphery of said body extending in the direction of said axis, at least one elongate cutter insert having at least one cutting edge at said periphery of the body and extending axially of the body, and clamping means displaceably mounted on the body, said clamping means for said at least one cutter insert comprising a pair of spaced clamping faces directed obliquely inwards of the body at opposite inclinations to said periphery for engagement with the cutter insert, the clamping means for said at least one cutter insert being located within a part of the axial length of the body and said at least one insert having ends that project beyond the clamping means, axially outer bearing faces carried by said body beyond said part of the axial length and said projecting ends held against said outer bearing faces by said clamping means, at least one further bearing face carried by said body within said part of the axial length, said outer bearing faces being at a greater radial distance from the axis of rotation of the cutter than said further bearing face, said clamping means having freedom of movement towards and away from the rotary axis of the body for applying a generally radially inward force clamping said cutter insert releasably upon the body, whereby to hold the insert against said bearing faces for giving said operative cutting edge of the insert a concave profile.

6. A cutter according to claim 5 wherein there are a series of discrete bearing faces projecting to different radial distances for contact with the insert at spaced regions along its length, the clamping means comprising a plurality of clamping elements having engagements with the insert at locations between successive bearing faces.

7. A cutter according to claim 6 wherein the insert is clamped by two said clamping elements and the bearing faces lie parallel to the rotary axis with the faces outside the span of said clamping elements at a greater radius from the axis of rotation of the body, said at least one bearing face within said span being spaced from the adjacent clamps.

8. A cutter comprising a body having an axis of rotation, a periphery of said body extending in the direction of said axis, at least one elongate cutter insert having at least one cutting edge at said periphery of the body and extending axially of the body, a series of discrete bearing faces projecting to different distances with respect to said axis for contact with said at least one cutter insert at spaced regions along its length, and clamping means displaceably mounted on the body with freedom of movement towards and away from the rotary axis of the body for applying a generally radially inward force clamping said cutter insert releasably against the bearing faces, the clamping means for said at least one cutter insert comprising a plurality of clamping elements having engagements with the insert at locations between successive bearing faces, the bearing faces comprising mutually remote axially outer faces and at least one further face between and spaced from said outer bearing faces, said outer bearing faces being at a greater radial distance from the axis of rotation than said at least one further bearing face, whereby to give an operative cutting edge of said at least one cutter insert a concave profile.

9. A cutter according to claim 8, wherein said at least one insert is clamped by two clamping elements disposed between a respective outer bearing face and said further bearing face, and the bearing faces lie parallel to the rotary axis with said outer faces at a greater radius from the axis of rotation of the body, said at least one further bearing face is located between and axially spaced from the clamping elements.

10. A cutter comprising a body having an axis of rotation, a periphery of said body extending in the direction of said axis, at least one elongate cutter insert having at least one cutting edge at said periphery of the body and extending axially of the body, said insert including at least one surface extending axially and oriented at an angle relative to a radial direction of said body, an elongate support for said at least one insert mounted adjustably on the periphery of the body and extending substantially axially thereon, clamping means displaceably mounted on said support for clamping the cutter insert to said support, said clamping means having means for adjustment relative to its support in a substantially radial direction towards and away from the rotary axis of the body for applying a substantially radially inward clamping force to said at least one surface for releasably clamping said at least one insert to the support in response to the application of clamping pressure to said clamping means, and tightening means accessible in the substantially axial direction for applying said clamping pressure to said clamping means.

11. A cutter according to claim 10 wherein the support is in the form of a bar-like member generally coextensive with the cutting insert to support the insert along its length.

12. A cutter according to claim 10, wherein said tightening means are carried by said support and are displaceable axially.

13. A cutter comprising a body having an axis of rotation, a periphery of said body extending in the direction of said axis, at least one elongate cutter insert having at least one cutting edge at said periphery of the body and extending axially of the body, an elongate support for said at least one insert mounted adjustably on the periphery of the body and extending substantially axially thereon, and clamping means displaceably mounted on said support for clamping the cutter insert thereon, said clamping means having means for adjustment on its support towards and away from the rotary axis of the body for applying a generally radially inward force clamping said at least one insert releasably upon the support, said support comprising a seating intermediate its length for pivoting movement of the support so as to allow tilting of the cutting insert substantially radially of the body.

14. A cutter comprising a body having an axis of rotation, a periphery of said body extending in the direction of said axis, at least one elongate cutter insert having at least one cutting edge at said periphery of the body and extending axially of the body, an elongate support for said at least one insert mounted adjustably on the periphery of the body and extending substantially axially thereon, and clamping means displaceably mounted on said support for clamping the cutter insert thereon, said clamping means having means for adjustment on its support towards and away from the rotary axis of the body for applying a generally radially inward force clamping said at least one insert releasably upon the support, wherein the clamping means for said at least one cutter insert being located within a part of the axial length of the support and the insert has ends that project beyond the clamping means, axially outer bearing faces on said support beyond said part of the axial length having said projecting ends held against them by said clamping means, at least one further bearing face on said body within said part of the axial length, said outer bearing faces being at a greater radial distance from the axis of rotation of the cutter than said further bearing face, whereby to given an operative cutting edge of the insert a concave profile.

* * * * *